United States Patent [19]

Coyle et al.

[11] Patent Number: 4,647,216

[45] Date of Patent: Mar. 3, 1987

[54] APPARATUS AND METHOD FOR MEASURING THE TIME ELAPSED IN INCREASING OR IN DECREASING VEHICLE SPEED FROM ONE PREDETERMINED SPEED TO A SECOND, HIGHER OR LOWER PREDETERMINED SPEED

[76] Inventors: Jan R. Coyle, Space 6A, 321 Clay St., Ashland, Oreg. 97520; Robert W. Stevens, 267 Louette Ct., Hayward, Calif. 94541

[21] Appl. No.: 716,821

[22] Filed: Mar. 27, 1985

[51] Int. Cl.[4] ..... G04F 8/00

[52] U.S. Cl. ..... 368/2; 368/8

[58] Field of Search ..... 368/2, 8; 324/178

[56] References Cited

U.S. PATENT DOCUMENTS 3,643,158 2/1972 Kroner et al. ..... 368/2

3,652,011 3/1972 West ..... 368/2

*Primary Examiner*—Bernard Roskoski

*Attorney, Agent, or Firm*—Kendrick, Netter & Bennett

[57] ABSTRACT

A device for measuring and displaying the time elapsed in increasing or in decreasing the speed of a vehicle from one predetermined velocity to another includes means for starting a clock at a predetermined, selectable speed, means for stopping the counter when a predetermined, higher or lower speed has been attained, means for displaying the time elapsed in increasing the predetermined starting speed to the predetermined, higher or lower ending speed, and means for resetting the clock counter.

19 Claims, 2 Drawing Figures

Figure 1:
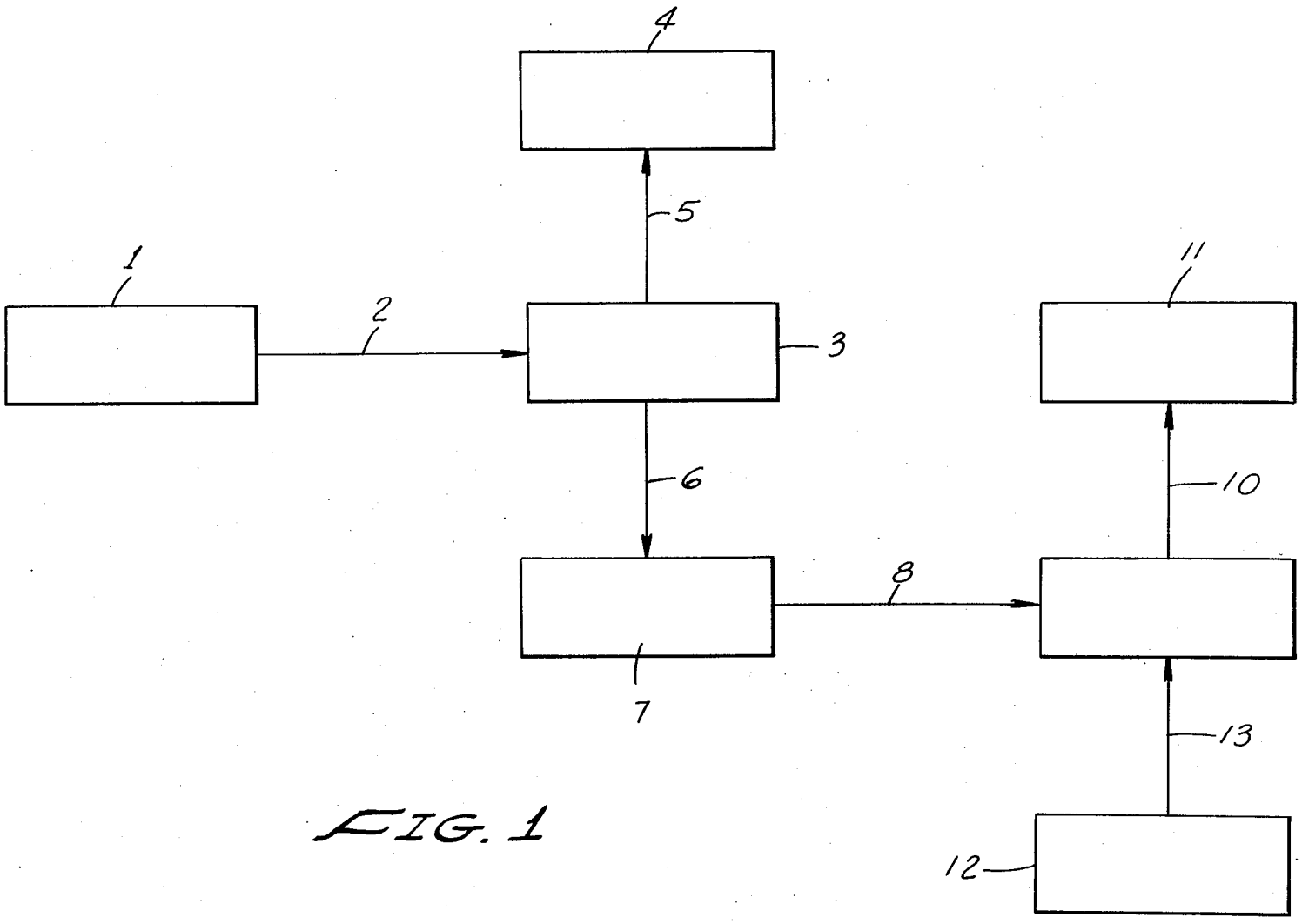

APPARATUS AND METHOD FOR MEASURING THE TIME ELAPSED IN INCREASING OR IN DECREASING VEHICLE SPEED FROM ONE PREDETERMINED SPEED TO A SECOND, HIGHER OR LOWER PREDETERMINED SPEED

This invention relates to a system and a method for measuring, precisely, and for displaying the elapsed tme required to increase the speed of a vehicle such as an automobile from a first predetermined speed to a second, higher predetermined speed, or to decrease the speed of a vehicle from a first, predetermined speed to a second, lower predetermined speed. The system may include, or be linked to a speedometer, or other means for measuring the speed of the vehicle.

The new system of this invention comprises means for measuring the speed of a vehicle; means for setting a first, predetermined speed from which to measure the elapsed time for the vehicle to reach a second, higher or lower speed, including means for generating a signal to start a clock, counter or other means for measuring the elapsed time; means for setting a second, predetermined speed, higher or lower than the first predetermined speed, at which the elapsed time to be measured ends, including means for generating a signal to stop the counter or other means for measuring the elapsed time; and means for displaying the elapsed time.

The speedometer or other means for measuring vehicle speed in this sytem may be analog, but is, preferably, a digital device that measures and displays speeds in some unit of distance per unit of time, such as miles per hour or kilometers per hour.

The system also includes means for generating a signal to start a clock, counter or other means for measuring time elapsed when the speed of the vehicle linked to this system reaches a first predetermined, selectable speed in the range, say of zero to some predetermined maximum, such as 99 miles or kilometers per hour.

The system also includes means for generating a signal when the vehicle linked to the system has attained a second, predetermined, selectable higher (or lower) speed for stopping the clock, counter or other means to permit measuring the time elapsed in increasing or decreasing vehicle speed from the first predetermined speed to the second predetermined speed.

The means for generating a signal representing the start of the time interval to be measured, i.e., the first, predetermined, selectable vehicle speed, includes means operatively linked to a speedometer on the vehicle or to other means for measuring the speed of the vehicle; means for selecting the speed at which the timing interval is to begin; and means for generating a signal to trigger the start of the timing interval.

The means for generating a signal representing the end of the time interval to be measured, i.e., the second predetermined, selectable vehicle speed, includes means operatively linked to a speedometer or to other means for measuring the speed of the vehicle; means for selecting the speed at which the timing interval is to end; and means for generating a signal to trigger the end of the timing interval.

Both the means for generating a signal to start the measurement of the timing interval, and the means for generating a signal to stop measurement of the timing interval, are linked to means for measuring the timing interval. This means for measuring the timing interval includes means for receiving the signal starting the measurement of the time interval, means for receiving the signal ending the timing interval, and means for resetting the measuring means for reuse.

The system also includes means for displaying the elapsed time between the speed selected for the beginning point of the timing interval and the second, higher or lower speed selected as the end point of the timing interval.

The new method for measuring the time required for the speed of a vehicle to increase or to decrease from a first predetermined speed to a second, higher (or lower) predetermined speed comprises: measuring the speed of a vehicle; selecting a first speed (for example, in the range, say from zero to a predetermined maximum value) at which the measurement of elapsed time is to begin; selecting a second, higher or lower speed at which the timing interval is to end; generating a signal representing the speed at which the timing interval is to begin when the vehicle reaches the selected starting time; starting a timing device to measure precisely the time required to reach the selected second, higher or lower speed; generating a signal to stop the timing device when the vehicle reaches the selected second, higher or lower speed; and detecting and displaying the time elapsed in increasing or decreasing the vehicle's speed from the first selected speed to the second selected speed.

Figure 2:
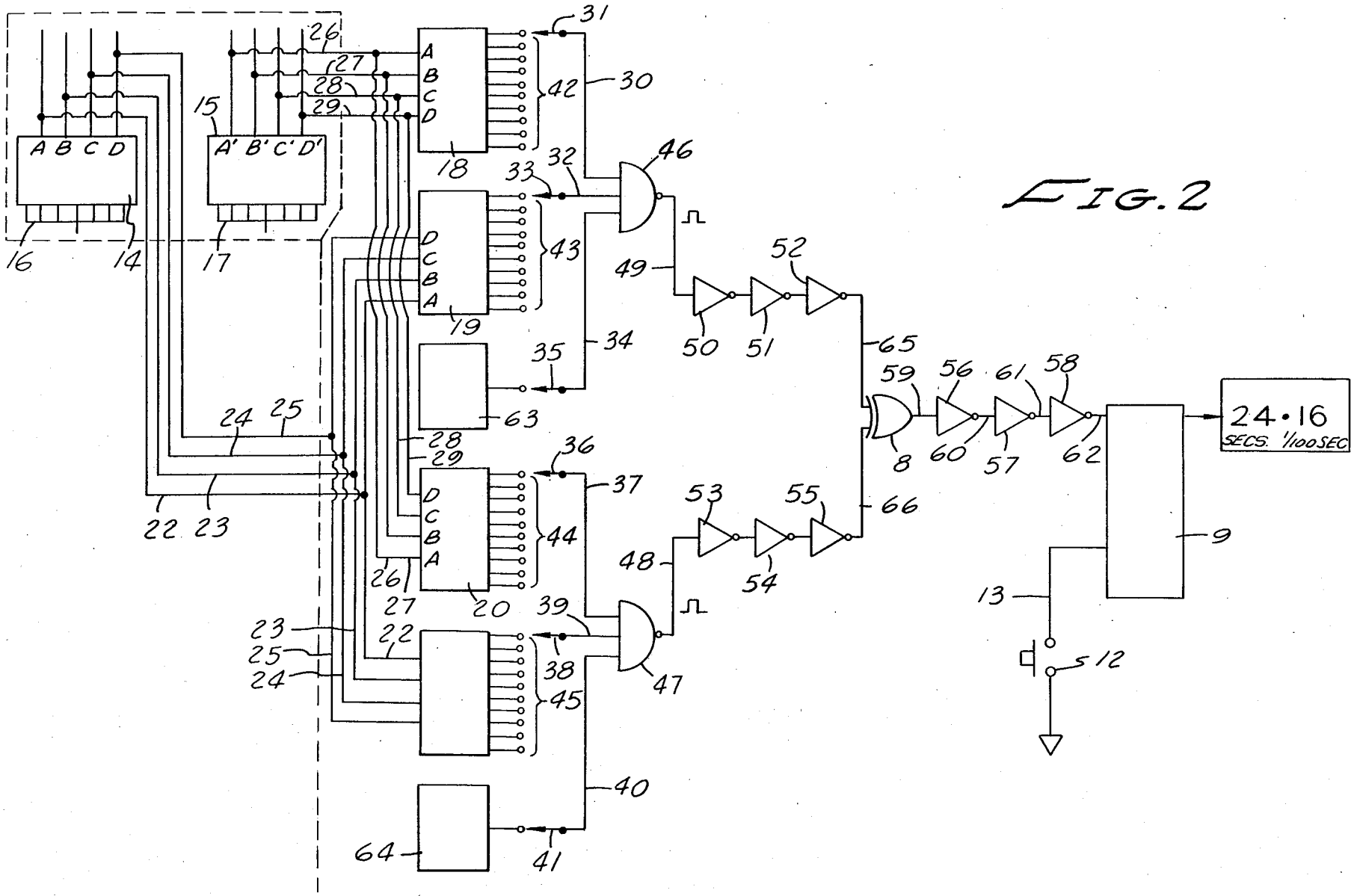

The invention can better be understood by reference to the accompanying drawings in which:

FIG. 1 is a block function diagram of a preferred embodiment of the new system for measuring the time elapsed in increasing or in decreasing the speed of a vehicle from a first predetermined speed to a second predetermined speed; and FIG. 2 is a second, more detailed block function/wiring diagram of the preferred embodiment shown in FIG. 1.

FIG. 1 shows, in a block function diagram, a preferred embodiment of the new system for measuring the elapsed time in increasing (or decreasing) the speed of a vehicle from a first predetermined speed to a second, higher (or lower) predetermined speed. Data from means for detecting the speed of the vehicle, such as means linked to the wheel or axle or an automobile, sends a signal on path 2 to digital speedometer 3. The speed of the vehicle appears on display device 4 upon receipt of a signal from speedometer 3 on path 5. A signal representing the vehicle's speed also passes on path 6 to speed comparator 7.

Speed comparator 7 includes means for setting a first, predetermined speed representing the starting speed for a timing interval and means for setting a second, higher (or lower) speed representing the ending point of the timing interval. When the vehicle's speed reaches the first, predetermined speed, speed comparator 7 generates a signal on path 8 to start counter 9. Counter 9 is a device for measuring the timing interval.

Comparator 7 continues to receive speed data from speedometer 3 on path 6 after the counter has begun to measure the desired timing interval. When the vehicle speed reaches the second, higher (or lower) predetermined speed selected as the end point for the timing interval, comparator 7 issues a signal on path 8 to stop counter 9. Upon receipt of this end point signal, the counter stops, and issues a signal, representing the time elapsed, over the desired interval on path 10 to display device 11. Display device 11 shows the time elapsed in increasing (or decreasing) the speed of the vehicle from the selected starting speed to the selected ending speed in a suitable unit of time such as seconds. Activation of reset means 12 linked to counter 9 via path 13 resets the counter 9 to zero or another desired starting value.

FIG. 2 shows in greater detail a preferred embodiment of the new system depicted in FIG. 1. In FIG. 2, the speed data from speedometer 1, which includes two or more BCD to seven-segment decoder/drivers 14 and 15 with seven-segment digit readouts 16 and 17, respectively, passes continuously to digit select circuits 18, 19, 20 and 21 on paths 22/23/24/25 and paths 26/27/28/29. Switches 31, 33 and 35 permit selection of the units, tens and hundreds digits in the desired starting or ending speed for the desired timing interval. Switches 31, 33 and 35 can be set to any of the ten positions on BCD-to-decimal decoders 18, 19 and 63 for this purpose. Similarly, switches 36, 38 and 41 can be set to any of the ten positions on BCD to decimal decoders 20, 21 and 64 to select the starting or ending speed for the desired timing interval.

When decoders 18, 19 and 63 receive speed data from speedometer 1, indicating that the vehicle speed has attained the selected starting or ending speed, the signals on paths 30, 32 and 34 all go high, changing the signal at the output of NAND gate 46 from high to low. Similarly, when decoder group 20, 21 and 64 receives speed data that is the same as the units, tens, and hundreds digits selected through switches 36, 38 and 41, the signals on paths 37, 39 and 40 all go high, producing a high output on path 48 from NAND gate 47. Normally, the signals on paths 48/66 and 49/65 to exclusive OR gate 8 are both high. When the signal on either path 65 or 66 goes high, the signal on path 59 from exclusive OR gate 8 goes high, passes through shaping amplifiers 56, 57 and 58, via paths 60 and 61, and delivers a pulse to counter 9 on path 62. The first signal reaching counter 9 on path 62 activates counter 9; the second signal reaching counter 9 deactivates the counter, as, for example, at the end of a timing interval. The elapsed time between the start and stop pulses passes, in signal form, on path 10 to readout device 11 where the elapsed time may appear in suitable units, such as seconds and hundredths of seconds.

To use the device of FIGS. 1 and 2 in measuring the increase of a vehicle's speed from a first predetermined speed to a second predetermined speed, a user sets the desired starting speed for the timing interval through switches 31, 33 and 35, and the desired ending speed for the timing interval via switches 36, 38 and 41. When the vehicle's speed reaches the selected starting speed, decoders 18, 19 and 63 deliver high signals on paths 30, 32 and 34, to NAND gate 46, changing the output on NAND gate 46 from high to low. The low signal on path 49 passes through shaping and inverting amplifiers 50, 51 and 52, and then passes on path 65 to exclusive OR gate 8. Because the signal on paths 48 and 66 is still low at this time, the output on path 59 from exclusive OR gate 8 goes low. After shaping and inverting in amplifiers 56, 57 and 58, the high pulse on path 62 activates counter 9, beginning the timing of the desired interval.

Meanwhile, decoders 20, 21 and 64 would be continuously receiving speed data on paths 22/23/24/25 and 26/27/28/29. When the actual vehicle speed equals the speed selected through switches 36, 38 and 41, the signals on paths 37, 39 and 40 are all high at the input to NAND gate 47, producing a low output on path 48. The low signal on path 48 then passes through shaping and inverting amplifiers 53, 54 and 55, and the high output appears on path 66 as an input to exclusive OR gate 8. Because the vehicle speed is above the starting speed selected via switches 31, 33 and 35, the signal on path 65 at exclusive OR gate 8 is low at this time. Accordingly, the signal on path 59 goes high. After passing through shaping and inverting amplifiers 56, 57 and 58, this low signal passes, on path 62, to counter 9, turning off the counter, and ending the timing interval. The elapsed time between the beginning and ending pulses passes as a signal on path 10 to readout means 11, where the elapsed time from the selected starting speed to the selected ending speed appears in suitable units, say, in seconds and hundredths of seconds.

Activation of reset switch 12 delivers a signal on path 13 to counter 9, resetting the clock to its starting state.

If a user wishes to measure the time required to reduce vehicle speed from one speed to another, say from 50 miles per hour to 10 miles per hour, he would select the starting speed, namely 50 miles per hour, through switches 36, 38 and 41, and the ending speed through switches 31, 33 and 35. When vehicle speed drops from a speed above 50 miles per hour to 50 miles per hour, the signals on paths 37, 39 and 40 go high, producing a low output on path 48 from NAND gate 47. In turn, the high signal on path 66, coupled with a low signal on path 65, produces a pulse on paths 59 and 62 to activate counter 9, starting the timing of the interval.

When vehicle speed drops to the selected ending speed, namely 10 miles per hour, the signals on paths 30, 32 and 34 are all high, producing a low output on path 49 from NAND gate 46. The low output on path 49 appears as a high output on path 65 at exclusive OR gate 8. The signal on path 66 at 10 miles per hour is high, producing a low output on path 62. The signal on path 62 passes to counter 9, turning off the counter, and generating a signal representing the elapsed time on path 10. The elapsed time signal on path 10 passes to readout device 11, where the elapsed time appears in suitable units, such as seconds and hundredths of seconds. Again, engagement of reset switch 12 delivers a signal on path 13 to counter 9, resetting it to its initial state.

As explained above, engagement of reset button 12 resets the counter 9 to the desired starting value. Resetting may be necessary when vehicle speed reaches the selected starting speed, but then falls to or below, or rises to or above, the selected starting speed before attaining the selected ending speed of the desired timing interval.

What is claimed is:

1. A system for measuring the time required for the speed of a vehicle to decrease from a first predetermined speed to a second, lower predetermined speed comprising means for variably setting a first, predetermined speed from a range comprising a plurality of different speeds greater than zero from which to measure the elapsed time for said vehicle to reach a second lower predetermined speed, including means for generating a signal to start means for measuring said elapsed time; means for variably setting a second, predetermined speed, lower than said first predetermined speed, at which the elapsed time to be measured ends, including means for generating a signal to stop the means for measuring the elapsed time; means for measuring said elapsed time; and means for displaying the elapsed time.

2. A method for measuring the time required for the speed of a vehicle to increase, or alternatively, to decrease from a first predetermined speed to a second higher or lower predetermined speed comprises: measuring the speed of the vehicle; variably selecting a first speed from a range comprising a plurality of different speeds at which a timing interval is to begin; variably selecting a second, predetermined higher or lower speed at which said timing interval is to end; generating a signal representing the speed at which the timing interval is to begin when the vehicle reaches said first predetermined speed; starting a timing device to measure precisely the time required to reach the selected, second higher or lower speed; generating a signal to stop the timing device when the vehicle reaches the selected, second higher or lower speed; and detecting and displaying the time elapsed in increasing or in decreasing vehicle speed from the first selected speed to the second selected speed.

3. The system of claim 1 wherein said second speed is zero or a speed greater than zero.

4. The system of claim 3 wherein said setting means and said means for measuring said elapsed time are digital, and set said first speed and said second speed are measure said elapsed time precisely and accurately.

5. The system of claim 4 wherein each of said setting means is linked to the speedometer for said vehicle, and wherein signals from said speedometer are fed to means for determining that said vehicle has reached said first predetermined speed and means for determining that said vehicle has reached said second predetermined speed.

6. The system of claim 5 wherein said speedometer is a digital speedometer.

7. The system of claim 4 wherein said system includes means for electronically resetting said system to its initial condition at any speed of said vehicle.

8. The system of claim 1 wherein, alternatively, said means for setting a first predetermined speed can be set to a first predetermined speed of zero or a speed greater than zero, and said means for setting a second predetermined speed can be set to a second, higher speed than said first speed, and said system can measure the elapsed time for said vehicle to accelerate from said first speed to said second speed.

9. A system for measuring, precisely and accurately, the time required for the speed of a vehicle to increase from a first, predetermined speed to a second, higher predetermined speed comprising means for variably setting a first, predetermined speed from a range comprising a plurality of different speeds from which to measure the elapsed time for said vehicle to reach a second, higher predetermined speed, including means for generating a signal to start means for measuring said elapsed time; means for variably setting a second, predetermined speed higher than said first predetermined speed, at which the elapsed time to be measured ends, including means for generating a signal to stop the means for measuring the elapsed time; means for measuring said elapsed time; and means for displaying the elapsed time.

10. The system of claim 9 wherein said setting means and said means for measuring said elapsed time are digital, and set said first speed and said second speed, and measure said elapsed time precisely and accurately.

11. The system of claim 10 wherein each of said setting means is linked to the speedometer for said vehicle, and wherein signals from said speedometer are fed to means for determining that said vehicle has reached said first predetermined speed and means for determining that said vehicle has reached said second predetermined speed.

12. The system of claim 11 wherein said speedometer is a digital speedometer.

13. The system of claim 10 wherein said system includes means for electronically resetting said system to its initial condition at any speed of said vehicle.

14. The system of claim 9 wherein, alternatively, said means for setting a first, predetermined speed can be set to a first, predetermined speed of zero or a speed greater than zero, and said means for setting a second, predetermined speed can be set to a second, higer speed than said first speed, and said system can, in this alternative mode, measure the elapsed time for said vehicle to decelerate from said second speed to said first speed.

15. A system for measuring the time required for the speed of a vehicle to increase from a first predetermined speed to a second, higher predetermined speed comprising means for measuring the speed of said vehicle; means for variably setting a first, predetermined speed from which to measure the elapsed time for said vehicle to reach a second, higher predetermined speed including means for generating a signal to start means for measuring said elapsed time; means for variably setting a second, predetermined speed higher than said first predetermined speed, at which the elapsed time to be measured ends, including means for generating a signal to stop the means for measuring the elapsed time; means for measuring elapsed time precisely and accurately; and means for displaying said elapsed time, said means for measuring the speed of said vehicle being adapted to deliver signals representing said first and said second predetermined speeds to said system while continuing to measure vehicle speed at speeds between said first and said second predetermined speeds, at speeds higher than said second speed, and at speeds, if any, lower than said first speed.

16. The system of claim 15 wherein, alternatively, said means for setting a first, predetermined speed can be set to a first, predetermined speed of zero or a speed greater than zero, and said means for setting a second, predetermined speed can be set to a second, higher speed than said first speed, and said system can measure the elapsed time for said vehicle to decelerate from said second speed to said first speed.

17. The system of claim 16 wherein said setting means and said means for measuring said elapsed time are digital, and sets at said first speed and said second speed, and measures an elapsed time, precisely and accurately.

18. The system of claim 15 wherein each of said means is linked to the regular speedometer for said vehicle, and wherein signals from said regular speedometer are fed to said means for determining that said vehicle has reached said first, prdetermined speed and means for determining that said vehicle has reached said second, predetermined speed.

19. The system of claim 15 wherein said system includes means for electronically resetting said system to its initial condition at any speed of said vehicle.

* * * * *